US005403622A

United States Patent [19]

Nishi et al.

[11] Patent Number: 5,403,622

[45] Date of Patent: Apr. 4, 1995

[54] METHOD FOR FEEDING A COATING SOLUTION

[75] Inventors: Yasuo Nishi; Nobuhiro Ueno; Katsusuke Nagashima; Takayuki Kato; Nobuhiko Takashima; Kikuo Maeda, all of Tokyo, Japan

[73] Assignee: Konica Corporation, Tokyo, Japan

[21] Appl. No.: 86,911

[22] Filed: Jul. 6, 1993

[30] Foreign Application Priority Data

Jul. 7, 1992 [JP] Japan ..... 4-203043

[51] Int. Cl.[6] ..... B05D 1/26

[52] U.S. Cl. ..... 427/356; 427/402; 427/420; 118/411

[58] Field of Search ..... 427/356, 420, 402; 118/410, 411

[56] References Cited

FOREIGN PATENT DOCUMENTS 61-120668 6/1986 Japan .
1-139168 5/1989 Japan .

*Primary Examiner*—Shrive P. Beck
*Assistant Examiner*—Katherine A. Bareford
*Attorney, Agent, or Firm*—Frishauf, Holtz, Goodman & Woodward

[57] ABSTRACT

A method of coating an object by shifting from a first coating solution to a second coating solution. After a coating of the object with the first coating solution is finished, a washing solution is used to clean a coating pipe-line and a coater. Deaerated water is supplied to fill up the pipe-line and the coater by control of a multi-way valve which is located at an end of the coating pipe-line which is connected to one of a coater or an outlet for drainage. The multi-way valve is capable of shifting a fluid flow therethrough to one of the coater and to the outlet. With the multi-way valve in the outlet position the deaerated water is replaced in the pipe-line and the coater with the second coating solution. A slit inside the coater is dried, and the second coating solution is then conducted to the coater by shifting the multi-way valve to a coater position therefor.

14 Claims, 4 Drawing Sheets

METHOD FOR FEEDING A COATING SOLUTION

FIELD OF THE INVENTION

The present invention relates to a method for feeding a coating solution utilized in a coating apparatus wherein different kinds of coating solutions contained in at least one coating solution tank are provided to a coater successively for coating.

BACKGROUND OF THE INVENTION

Heretofore, coating of a coating solution was conducted by providing different kinds of coating solutions contained in at least one coating solution tank to a coater utilizing a common feeding tube while switching the feeding route.

In the above-mentioned method, it is necessary to wash the common feeding tube and the coater when a coating solution is switched because the feeding tube and the coater are common. In addition, when a coating solution is switched after passing water through a feeding pipe and a coater, foam is generated by the new solution in the common feeding pipe, caused by foam remaining after water is passed therethrough. When a coating solution is provided to a coater for coating without removing the foam, coating streaks and the like are caused due to the foam, which is inconvenient. Therefore, the foam is generally removed completely during the water passing step.

With regard to methods of removing foams by water-passing, a method of removing air remaining in a feeding route for a coating solution by providing deaerated water in advance to a feeding route for a coating solution after a feeding pipe and a coater that are commonly employed for a certain period of time as a detergent as described in Japanese Patent Publication Open to Public Inspection (hereinafter referred to as Japanese Patent O.P.I. Publication) No. 65824/1974 and a method of washing the common feeding pipe and coater employing deaerated hot water and an aqueous water having low surface tension are described in Japanese Patent O.P.I. Publication No. 207439/1991.

In addition, with regard to a problem of the occurrence of foam when feeding a solution, a method of preventing the occurrence of foam in a common feeding pipe by conducting operations wherein a vacuum pump is connected to a common feeding pipe by changing a valve for absorption, thereby causing a vacuum in the common feeding pipe and thereafter opening a valve of a pipe connecting tank of a coating solution which is desired to be fed when the common feeding pipe portion is closed due to closing a valve positioned at the rear portion of a common feeding pipe portion concurrently with closing of a valve of a pipe connecting a tank of a coating solution which is desired to be stopped feeding are described in Japanese Patent O.P.I. Publication No. 265639/1990.

In addition, a method of deaerating by means of heating and vacuum processing is described in Japanese Patent Publication No. 43722/1987.

Owing to the conventional methods described above, washing inside a common feeding pipe and prevention of remaining foam became possible. However, problems lie in a coater unit, too. Namely, heretofore, deaerated water for removing foam was provided inside of a coater. In such a case, when deaerated water is replaced with a coating solution in the succeeding step, replacement efficiency is poor so that uneven replacement occurs. In addition, when still foam occurs after water cleaning, foam is allowed to remain in a coater. Accordingly, as a measure to prevent foam, formation a thin film was inserted into the slits of a coater and drawn to the depth direction and the width direction so that uniform replacement inside a coater is obtained and removal of any remaining foam are conducted. The above-mentioned operation is performed manually. This thin film is applied to all slits (having 7 to 16 layers). This procedure causes a noticeable loss in time, deteriorating production efficiency remarkably. In addition, according to the conventional methods, constant loss in solution is so noticeable that it is disadvantageous in terms of reduction in production cost.

As described above, according to the conventional methods, loss occurred when time and solution in changing to a new coating solution after passing water through a line (a common feeding pipe) and a coater. If the above-mentioned losses in replacement can be eliminated, time necessary for switching a coating solution and loss in solutions can be saved remarkably, improving production efficiency noticeably.

SUMMARY OF THE INVENTION

As is apparent from the above, the object of the present invention relates to a technology applied to a coating apparatus wherein different kinds of coating solutions contained in at least one tank can be coated by the use of a coater utilizing a common feeding pipe and further relates to an improved coating method of a coating solution on an object wherein washing of a common feeding pipe and a coater, removal of foam, and replacement of solution are conducted efficiently so that time for switching coating solutions and a loss of the solution can be reduced remarkably.

Heretofore, water was passed through a coater before a coating solution was fed inside the coater after being washed because foam occurred due to remaining solution inside the coater. However, in the present invention, by drying slits of the coater after being washed, it becomes possible to feed a coating solution inside the coater directly for coating the object. Therefore, defoaming by the use of water and the replacement of water (deaerated water) by the coating solution becomes unnecessary. Namely, when the inside of the slit of the coater is dried after being washed, foam never occurs inside the slit of the coater even when a coatings solution is fed thereto directly. Accordingly, coating of high quality without a defect due to foam becomes possible. Owing to this diminution of foaming a time for defoaming inside the coater and a time for replacing foam water (deaerated water) by the coating solution can be shortened. In addition, inside the coater, loss in the volume of the coating solutions can be reduced noticeably because replacement foam water (deaerated water) to the coating solution is not conducted.

DETAILED DESCRIPTION OF THE INVENTION

Next, we will explain the method of the present invention in detail referring to attached drawings.

Figure 1:
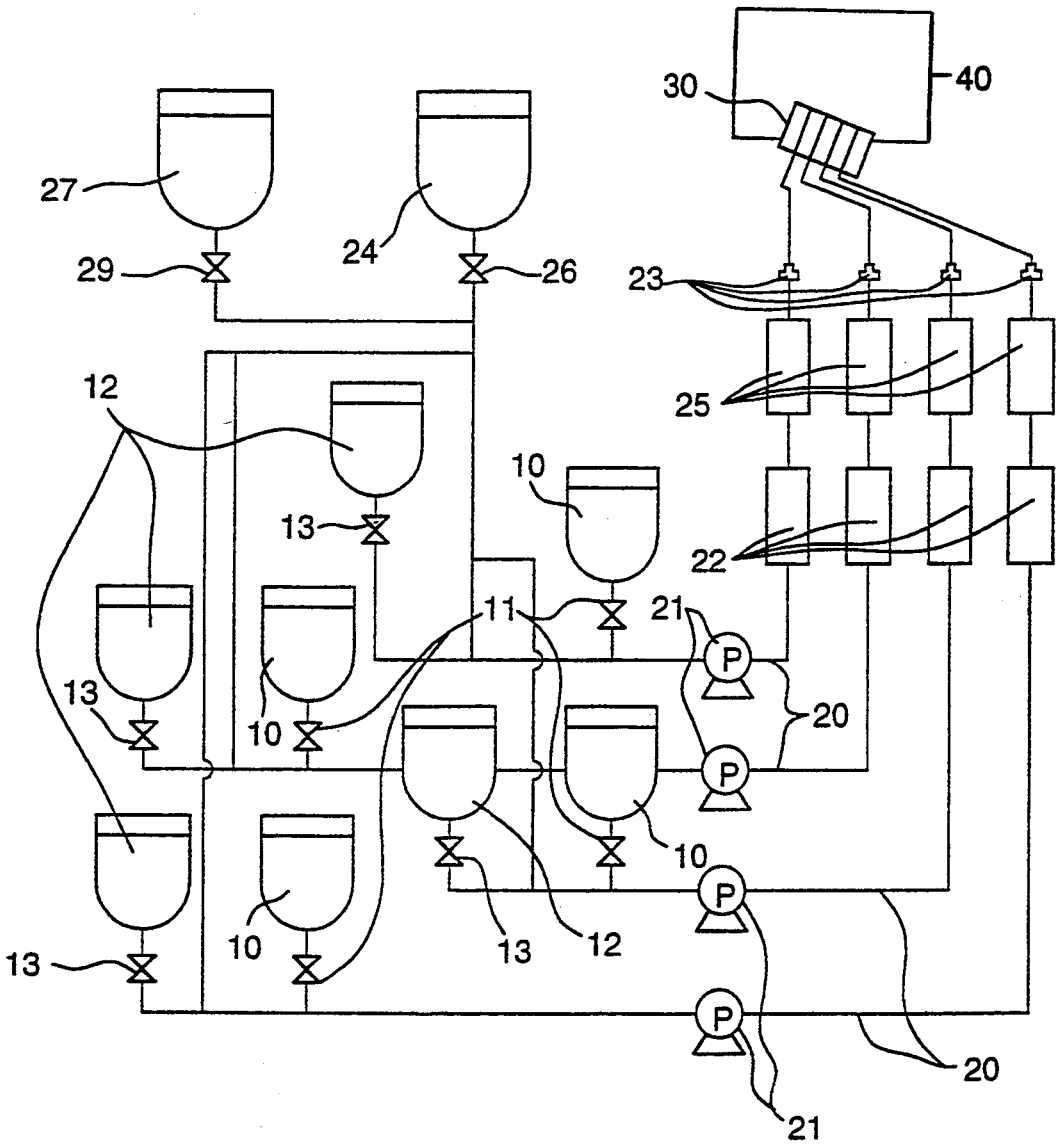
FIG. 1 shows a schematic drawing of an apparatus of the present invention, wherein individual layers are coated sequentially by a coater.

FIG. 1 shows an example of a schematic drawing of an apparatus employing a method of the present invention. Coating solutions are prepared in plural tanks for coating solutions respectively. By opening a valve 11 prepared for each tank for a coating solution, a coating solution contained in a specific tank for a coating solution 10 is introduced to a common feeding pipe 20. Then, it is fed to coater 30 through filter 22 by feeding pump 21 and valve for switching a feeding route 23. Incidentally, 24 represents a tank for deaerated water, 25 represents a defoaming apparatus and 27 represents a tank for holding a washing solution.

Figure 2:
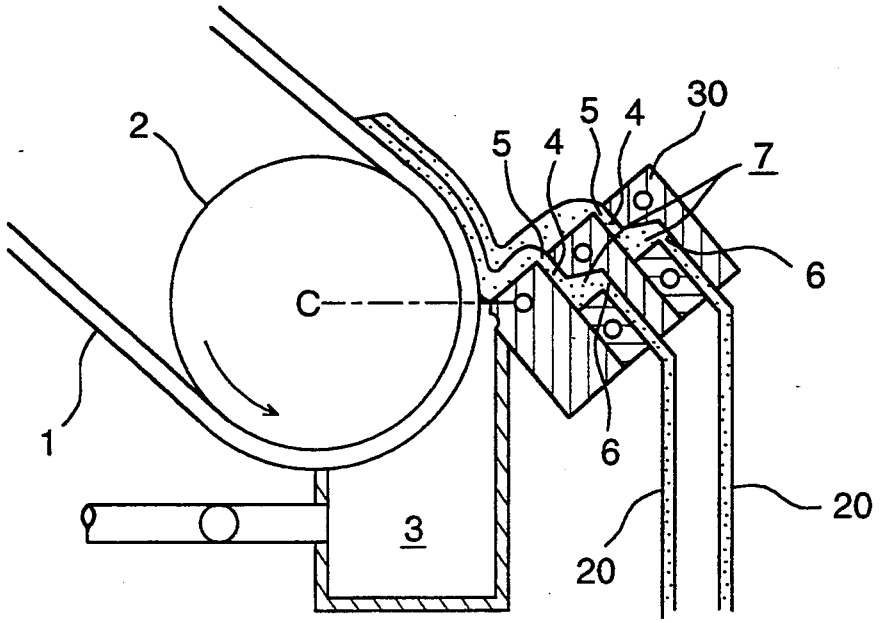
FIG. 2 shows an enlarged cross section of a coater of the present invention.

FIG. 2 shows an example of an enlarged cross section of a coater 30.

Next, we will explain how a coating solution of the invention is coated, referring to the above-mentioned apparatus.

At first, we will explain switching from a state wherein a coating solution stocked in tank 10 for a coating solution is filled in the portion from the common feeding pipe 20 to the coater 30 and another state wherein a different kind of coating solution is stocked in another tank 12 for a coating solution is filled in the portion from the common feeding pipe 20 to the coater 30.

Incidentally, the common feeding pipe 20 is referred to as a feeding pipe employed for sequentially feeding at least two kinds of coating solutions. However, the present invention also includes an embodiment of FIG. 4 wherein two or more lines of a feeding pipe are provided to one coater 22.

At first, the valve 11 at the tank for a coating solution 10 is closed. Then, while fixing a multi-way valve 23 on the coater side of the feeding pipe 20, valve 29 at a tank for a coating solution 27 is opened. By driving the solution feeding pump 21, the common feeding pipe 20 and the coater 30 are washed. After that, the valve 29 is closed. Next, valve 26 at the tank for deaerated water 24 is opened so that a washing solution and foams remaining inside the common feeding pipe 20 and the coater 30 is ejected by flow of deaerated water. It is ejected to a waste solution tank 40 for effluent through an ejection route not illustrated.

Next, the multi-way valve 23 is switched to an ejection position thereof so that deaerated water inside the coater is ejected and stored in waste water tank 40. Then, the water deaerated is passed through the feeding pipe lines 20 up to the multi-way valve 23.

Concurrently with the above-mentioned operations, deaerated water inside the coater 30 is ejected and the coater 30 is dried. In order to eject deaerated water inside the coater, the valve at the line passing from the lower side of the coater 30 to the effluent tank is opened so that the deaerated water is caused to drop naturally, or (heated) air is blown through an air-blowing pipe connected to the line on the lower side of the coater 30 so that the deaerated water is arranged to be ejected by means of the pressure.

In order to dry coater slits 4, heated air or unheated air is allowed to be blown through an air-blowing tube connected to the line on the lower side of the coater for ejecting the above-mentioned deaerated water, or heated air or unheated air is blown from an outlet of slits.

In addition, moisture is removed by inserting paper having high water absorption property or nonwoven fabric into the slits. In an embodiment wherein plural coaters 30 are connected to the common feeding pipe, when coating is conducted with new coater 30, the washed coater 30 is arranged to be dried naturally without blowing of air. Gas other than air is allowed to be employed. The coater is also allowed to be heated for drying.

Next, under the conditions that the valve 26 for the tank for the deaerating tank 24 is closed and the valve 13 for the succeeding water tank for the coating solution 12 is opened, the fluid in the line up to the multi-way valve 23 is replaced by driving the solution feeding pump 21 for ejecting deaerated water in the line to the effluent tank 40 through the multi-way valve 23. The linear flow speed in replacing to the coating solution is an important factor for minimizing replacement loss. The flow speed is ordinarily not more than 9 cm/sec, preferably not more than 6 cm/sec. and more preferably not more than 3 cm/sec.

A detecting sensor senses when a replacement-completion has occurred sensing and density, turbidity or electroconductivity. When the sensor detects that a replacement of deaerated water with a coating solution has occurred, the multi-way valve 23 is switched to the coater 30 side in synchronization with the signal. The coating operation can be started again when the coating solution is discharged from plural outlets of the slit portion concurrently or from the lowest layer of the slit portion in order that the slide surface is ready for coating. Table I below shows various linear flow speeds, provided that the flow rate is defined to be a linear flow speed for an allowable range of solution viscosity) when the slits are dry and wet.

TABLE 1

| Linear flow speed (cm/sec.) | Viscosity (CP) When the slits are dry Viscosity (CP) 1 | 8 | 40 | 100 | When the slits are wet Viscosity (CP) 1 | 8 | 40 | 100 |
|---|---|---|---|---|---|---|---|---|
| 5 | X | ○ | ○ | ○ | X | X | X | X |
| 15 | X | ○ | ○ | ○ | X | X | X | X |
| 20 | X | X | X | X | X | X | X | X |
| 30 | X | X | X | X | X | X | X | X |

wherein O represents OK, wherein no foam exists and X represents NG i.e., NO GOOD, wherein at least one foam exists.

Incidentally, the linear flow speed in replacing the deaerated water with the coating solution is necessary to be included within the range so as not to cause disturbance at the interface of the leading portion of the solution at the inlet portion of the manifold 6 of FIG. 2. In an example, coating solutions having various viscosities and having various linear flow speed were conducted into a washed coater wherein the slits were dried and wet as shown in Table I above. By a coater unit model, specially made of a transparent resin, the occurrence of foam was experimentally observed. The results are shown in Table 1, wherein it turned out that feeding of a solution without the occurrence of foam is possible by controlling the viscosity to be 8 CP or more and controlling the linear flow speed to 15 cm/sec. or less.

Table 1 shows the case when the surface tension is 40 dyne/cm, wherein it turned out that there was no occurrence of foam even when the surface tension of the solution is in the range of 20 to 75 dyne/cm provided the slits were dry.

In the above-mentioned solution-feeding method, it is allowed to be arranged that, succeeding replacing of the deaerated water inside the line, the pressure inside the line is reduced concurrently with an ejection of the deaerated water to waste water tank 40 and then the coating solution is introduced in such a condition. Namely, when the valve 13 at the tank 12 for the coating solution, the valve 26 at the tank 24 for the deaerated water and the valve 29 at the tank 27 for the washing solution are closed, the pressure inside the tank 12 for the coating solution, the pressure in the common feeding pipe 20 and the pressure in the coater 30 are reduced and when the valve 13 at the tank 12 for the coating solution is then opened under the reduced pressure so that the coating solution is fed. In order to reduce the pressure inside the line, a vacuum pump is utilized. By reducing the pressure, replacement of the coating solution is conducted smoothly and the occurrence of foam in the coating solution inside the line can be prevented.

The coating methods of a coating solution in the present invention include an embodiment wherein a coating solution and a deaerated water are fed to the coater 30 without employing the solution feeding pump 21. The embodiment is as follows. In a method for coating two or more coating solutions contained in one or more tanks 12, the coating solutions are fed to the coater 30 for coating by utilizing: a common feeding pipe; a means for adding pressure inside the tank 12 for a coating solution; tank 24 for deaerated water; and a washing solution tank; a valve 31 (FIG. 4) for controlling a linear flow speed positioned at the common feeding pipe 20 which is located prior to the coater 30; and the multi-way valve 23. By feeding washing solution to the common pipe 20 while the valve 11 at the tank 10 for the coating solution is closed and the valve at the tank 27 for the washing solution is opened, the coating solution remaining in the common feeding pipe 20 and in the coater 30 is ejected. Next, after the washing solution is ejected while the valve 29 is closed and the valve 26 at the tank 24 for the deaerated water is opened, the deaerated water inside the coater 30 is ejected concurrently with replacing the coating solution inside the common feeding pipe 20 with the deaerated water by switching the multi-way valve 23 to the ejection side. Then, drying air is provided inside the coater 30 for drying. Furthermore, while the valve 26 at the tank 24 for the deaerated water is closed and the valve 13 at the tank 12 for the coating solution is opened, the coating solution in the pressure-added tank 12 for the coating solution is fed to the common feeding pipe 20 so that the deaerated water inside the common feeding pipe 20 is ejected and replaced with a new coating solution. Upon completion of this replacement, the multiway valve 23 is switched to the side of the coater 30 already dried so that a new coating solution is fed to the coater 30.

According to the above-mentioned method, a solution-feeding pump 21 is not employed. It is only necessary to add compressed air to the closed tank 12 for a coating solution, to the tank 27 for the washing solution and to the tank 24 for the deaerated water for adding pressure, in order to feed the solution. This method has an advantage that the foam produced due to the drive of the solution-feeding pump 21 does not occur in FIG. 1.

In addition, as shown in FIG. 1, the line from the solution-feeding pump 21 up to the multi-way valve 23 and the coater 30 is desirable to be arranged in a manner that the coating solution and the deaerated water flow upwardly. On the contrary, in the case that the line is arranged so that the coating solution or the deaerated water is fed downward, the deaerated water will be replaced with the coating solution and the coating solution is forced to be fed in a wedge shape to the deaerated water area at the border portion of both solutions because the coating solution has a higher specific gravity. Therefore, the portion where both solutions are mixed must be ejected, causing a remarkable loss of coating solution.

The above-mentioned coating method includes an embodiment wherein deaerating-washing water, i.e. deaerated water and washing solution mixed together, is fed for washing the common feeding pipe 20 and the coater 30 and an embodiment wherein deaerated water and washing solution are fed in reverse order. Another embodiment is to add the deaerated water and the washing solution at the same time.

In addition, in the embodiment shown in FIG. 1, it is arranged that the multi-way valve 23 is located just before the coater 30. However, it is possible that the multi-way valve 23 is arranged prior to the deaerated apparatus 25. In the latter embodiment, the deaerated apparatus 25 is allowed to be washed (dried) in the same line as one washing (drying) the coater 30. In addition, it is possible to (dry) in a separate line from the coater 30.

In addition, in another embodiment wherein plural coaters 30 are provided, each fed by an apparatus of FIG. 1, the line is switched to the coater side that is already washed and dried by the use of the multi-way valve 23 so that a new coating solution replaces the deaerated water and is fed and each of the coaters 30 is washed and dried in a separate process is also included in the present invention. In addition, the present invention also includes the above-mentioned embodiment wherein the coaters 30 are washed concurrently with the common feeding pipe 20 and only the washing solution is ejected and the water is dried in an another process.

When the fluid in the line through which deaerated water is passed is replaced with the coating solution, it is not preferable that the excessive amount of coating solution is ejected outside the line as effluent because it is considered to be a loss of solution. The above-mentioned loss occurs due to the interface contact of both solutions that is in a wedge shape caused by the difference of both solutions in terms of specific gravity and viscosity and friction resistance with the wall inside the pipe. Namely, at the portion wherein both solutions contact, the coating solution protrudes into the deaerated water in a wedge shape in view of the central cross sectional shape thereof. It turned out that the length of this wedge portion is related to linear flow speed. FIG. 2 depicts coater 30, slits 4, reservoir 7 and common feeding pipe 20.

Figure 3:
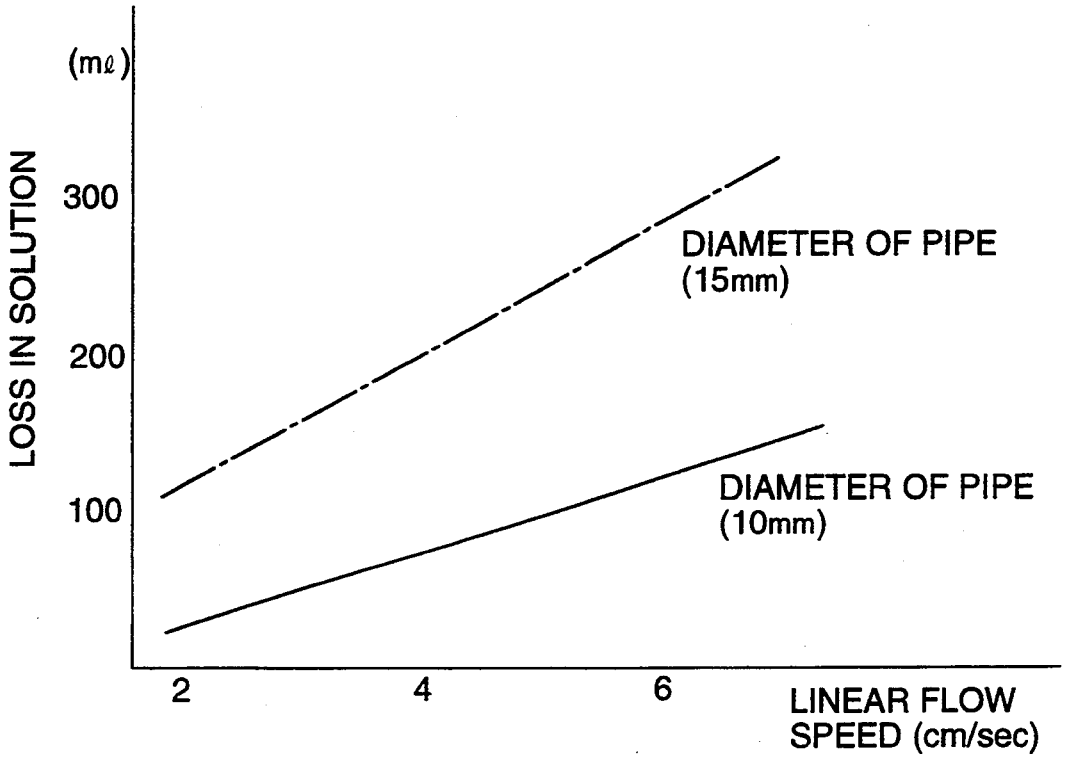
FIG. 3 shows a graph showing loss in a solution.

When comparing as shown in FIG. 3 a pipe having a diameter of 15 mm with one having a diameter of 10 mm when the pipe length is 400 mm and when the viscosity of the coating solution is 40 cps, it turned out that there were differences in loss in solution as shown in FIG. 3. As is apparent from FIG. 3, that the larger the pipe diameter is, the larger the loss in solution is in the case of the same linear flow speed is the same. In addition, when the diameter of the pipes are the same, the higher the linear flow speed, the greater is the loss in solution.

Figure 4:
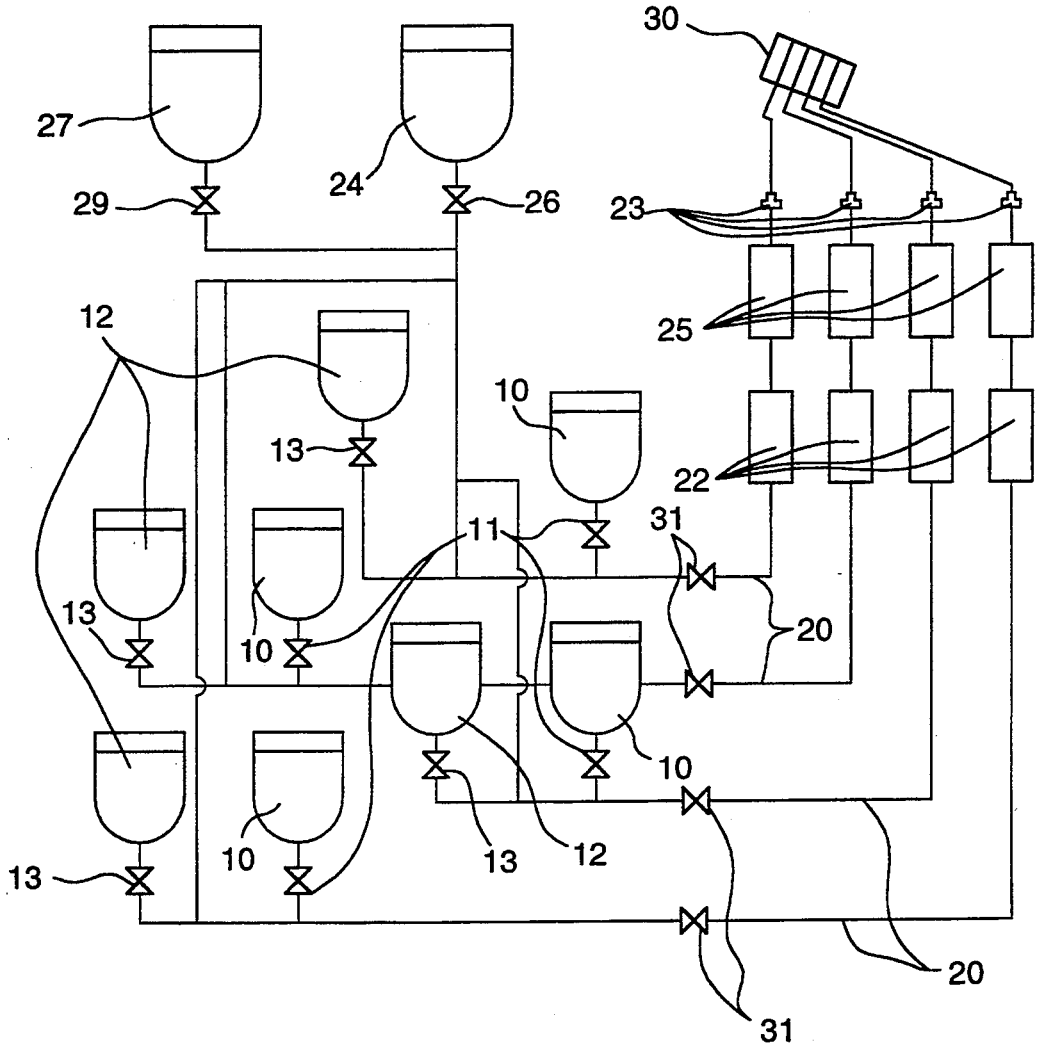
FIG. 4 shows another schematic drawing of another embodiment of the apparatus of the present invention, wherein a plurality of coating layers can be coated simultaneously by the coater.

When the coater 30 has a plurality of slits as shown in FIGS. 1 and 4, as noted above, each slit can be fed with coating solutions through an apparatus similar to that shown in FIGS. 1 or 4. When the slits are fed simultaneously with coating solutions from the apparatus similar to that shown in FIGS. 1 or 4 respectively, then it is possible to coat a plurality of coating solutions simultaneously on an object by use of a single coater. This can be achieved by flowing a first coating solution through a lowermost slit of said plurality of slits in the coater. Simultaneously, with the flowing of the first coating solution through the first slit, second, third and other coating solutions are flowed through the second, third and other slits of the coater so that a plurality of coating layers are formed by the coater on an object simultaneously.

Owing to the present invention, a coating solution can be replaced without operating removal of foam inside the coater which has heretofore been conducted manually so that operation efficiency can be improved remarkably. Thus, the problem described at the beginning of the present specification can be solved.

What is claimed is:

1. A method of coating with a coater in which a reservoir for holding a coating solution and at least one slit communicating with the reservoir are provided, wherein a coating solution is supplied to the reservoir and extruded through the slit;

the method comprising:

washing the reservoir and the slit with a washing solution so as to remove any remaining coating solution from a previous coating;

removing the washing solution from the reservoir and the slit;

drying at least the slit so as to free the slit from any solution; and carrying out a coating by supplying a coating solution to the reservoir, while maintaining the slit in a dry condition and by extruding the coating solution from the slit.

2. The method of claim 1, wherein the drying is conducted by blowing air.

3. The method of claim 2, wherein the air is hot air.

4. The method of claim 3, wherein the air is blown to the slit through the reservoir.

5. The method of claim 3, wherein the air is blown to the slit from outside of the coater.

6. The method of claim 1, wherein the drying is conducted by the use of a water-absorbing member.

7. The method of claim 1, wherein the coating solution is supplied at a flowrate not higher than 15 cm/seconds.

8. The method of claim 7, wherein the coating solution has a viscosity of not less than 8 cps.

9. The method of claim 1, wherein the coating solution has a viscosity of not less than 8 cps.

10. The method of claim 1, wherein the coating solution has a surface tension of 20 to 75 dyne/cm.

11. The method of claim 10, wherein the coating solution has a viscosity of less than 8 cps.

12. The method of claim 11, wherein the coating solution is supplied at a flowrate not higher than 15 cm/seconds.

13. The method of claim 1, wherein after the washing, the washing solution is replaced with deaerated water, and the drying is conducted after removing the deaerated water from the reservoir and the slit.

14. The method of claim 1, wherein the coating solution supplied after the drying is different from coating solution remaining before the washing.

* * * * *